US007053788B2

(12) United States Patent
Hall et al.

(10) Patent No.: US 7,053,788 B2
(45) **Date of Patent: *May 30, 2006**

(54) TRANSDUCER FOR DOWNHOLE DRILLING COMPONENTS

(75) Inventors: David R Hall, Provo, UT (US); Joe R Fox, Provo, UT (US)

(73) Assignee: IntelliServ, Inc., Provo, UT (US)

( * ) Notice: Subject to any disclaimer, the term of this patent is extended or adjusted under 35 U.S.C. 154(b) by 469 days.

This patent is subject to a terminal disclaimer.

(21) Appl. No.: 10/453,076

(22) Filed: Jun. 3, 2003

(65) Prior Publication Data

US 2004/0246142 A1 Dec. 9, 2004

(51) Int. Cl.
*G08U 3/00* (2006.01)

(52) U.S. Cl. ..... 340/854.4; 340/854.8; 340/854.3; 336/90; 285/328; 285/333

(58) Field of Classification Search ..... 340/854.3, 340/854.8; 336/132, 90, 105; 174/98; 439/577, 439/194, 190, 191; 367/83; 285/328, 333, 285/332.4

See application file for complete search history.

(56) References Cited

U.S. PATENT DOCUMENTS

| | | | |
|---|---|---|---|
| 0,749,633 | A | 1/1904 | Seeley |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |
| 2,659,773 | A | 11/1953 | Barney |
| 2,662,123 | A | 12/1953 | Koenig, Jr. |
| 2,748,358 | A | 5/1956 | Johnston |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |
| 3,170,137 | A | 2/1965 | Brandt |
| 3,186,222 | A | 6/1965 | Martin |
| 3,194,886 | A | 7/1965 | Mason |
| 3,209,323 | A | 9/1965 | Grossman, Jr. |
| 3,227,973 | A | 1/1966 | Gray |
| 3,253,245 | A | 5/1966 | Brandt |
| 3,518,608 | A | 6/1970 | Papadopoulos |
| 3,696,332 | A | 10/1972 | Dickson, Jr. et al. |
| 3,793,632 | A | 2/1974 | Still |

(Continued)

FOREIGN PATENT DOCUMENTS

| | | | |
|---|---|---|---|
| EP | 0399987 | A1 | 11/1990 |

(Continued)

*Primary Examiner*—Albert K. Wong
(74) *Attorney, Agent, or Firm*—Jeffery E. Daly; Tyson J. Wilde

(57) ABSTRACT

A robust transmission element for transmitting information between downhole tools, such as sections of drill pipe, in the presence of hostile environmental conditions, such as heat, dirt, rocks, mud, fluids, lubricants, and the like. The transmission element maintains reliable connectivity between transmission elements, thereby providing an uninterrupted flow of information between drill string components. A transmission element is mounted within a recess proximate a mating surface of a downhole drilling component, such as a section of drill pipe. The transmission element may include an annular housing forming a trough, an electrical conductor disposed within the trough, and an MCEI material disposed between the annular housing and the electrical conductor.

20 Claims, 6 Drawing Sheets

U.S. PATENT DOCUMENTS 3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 MacLeod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,223,826 B1 5/2001 Chau et al.
6,367,565 B1 4/2002 Hall
6,392,317 B1 5/2002 Hall et al.
6,405,795 B1 6/2002 Holbert et al.
6,641,434 B1 11/2003 Boyle et al.
6,655,464 B1 12/2003 Chau et al.
6,670,880 B1 12/2003 Hall et al.
6,717,501 B1 * 4/2004 Hall et al. ..... 336/132
6,830,467 B1 * 12/2004 Hall et al. ..... 439/194
6,844,498 B1 * 1/2005 Hall et al. ..... 174/75 C
2002/0075114 A1 * 6/2002 Hall et al. ..... 336/192
2002/0135179 A1 9/2002 Boyle et al.
2002/0193004 A1 12/2002 Boyle et al.
2003/0070842 A1 4/2003 Bailey et al.
2003/0213598 A1 11/2003 Hughes
2004/0104797 A1 * 6/2004 Hall et al. ..... 336/132
2004/0145492 A1 * 7/2004 Hall et al. ..... 340/854.3
2004/0149471 A1 * 8/2004 Hall et al. ..... 174/21 R
2004/0164833 A1 * 8/2004 Hall et al. ..... 336/132
2004/0164838 A1 * 8/2004 Hall et al. ..... 336/234
2004/0219831 A1 * 11/2004 Hall et al. ..... 439/578
2005/0001738 A1 * 1/2005 Hall et al. ..... 340/854.8
2005/0145406 A1 * 7/2005 Hall et al. ..... 174/37
2005/0212530 A1 * 9/2005 Hall et al. ..... 324/642

FOREIGN PATENT DOCUMENTS

WO W8801096 2/1988
WO WO9014497 11/1990

* cited by examiner

TRANSDUCER FOR DOWNHOLE DRILLING COMPONENTS

This invention was made with government support under Contract No. DE-FC26-97FT343656 awarded by the U.S. Department of Energy. The government has certain rights in the invention.

BACKGROUND OF THE INVENTION

1. The Field of the Invention

This invention relates to oil and gas drilling, and more particularly to apparatus and methods for reliably transmitting information to the surface from downhole drilling components.

2. The Relevant Art

For several decades, engineers have worked to develop apparatus and methods to effectively transmit information from components located downhole on oil and gas drilling strings to the ground's surface. Part of the difficulty lies in the development of reliable apparatus and methods for transmitting information from one drill string component to another, such as between sections of drill pipe. The goal is to provide reliable information transmission between downhole components stretching thousands of feet beneath the earth's surface, while withstanding hostile wear and tear of subterranean conditions.

In an effort to provide solutions to this problem, engineers have developed a technology known as mud pulse telemetry. Rather than using electrical connections, mud pulse telemetry transmits information in the form of pressure pulses through fluids circulating through a well bore. However, data rates of mud pulse telemetry are very slow compared to data bandwidths needed to provide real-time data from downhole components.

For example, mud pulse telemetry systems often operate at data rates less than 10 bits per second. At this rate, data resolution is so poor that a driller is unable to make crucial decisions in real time. Since drilling equipment is often rented and very expensive, even slight mistakes incur substantial expense. Part of the expense can be attributed to time-consuming operations that are required to retrieve downhole data or to verify low-resolution data transmitted to the surface by mud pulse telemetry. Often, drilling or other procedures are halted while crucial data is gathered.

In an effort to overcome limitations imposed by mud pulse telemetry systems, reliable connections are needed to transmit information between components in a drill string. For example, since direct electrical connections between drill string components may be impractical and unreliable, other methods are needed to bridge the gap between drill string components.

Various factors or problems may make data transmission unreliable. For example, dirt, rocks, mud, fluids, or other substances present when drilling may interfere with signals transmitted between components in a drill string. In other instances, gaps present between mating surfaces of drill string components may adversely affect the transmission of data therebetween.

Moreover, the harsh working environment of drill string components may cause damage to data transmission elements. Furthermore, since many drill string components are located beneath the surface of the ground, replacing or servicing data transmission components may be costly, impractical, or impossible. Thus, robust and environmentally-hardened data transmission components are needed to transmit information between drill string components.

SUMMARY OF THE INVENTION

In view of the foregoing, it is a primary object of the present invention to provide robust transmission elements for transmitting information between downhole tools, such as sections of drill pipe, in the presence of hostile environmental conditions, such as heat, dirt, rocks, mud, fluids, lubricants, and the like. It is a further object of the invention to maintain reliable connectivity between transmission elements to provide an uninterrupted flow of information between drill string components.

Consistent with the foregoing objects, and in accordance with the invention as embodied and broadly described herein, an apparatus for transmitting data between downhole tools is disclosed in one embodiment of the present invention as including an annular housing having a circumference. The annular housing is shaped to include a trough around the circumference thereof. An electrical conductor is disposed within the trough. A magnetically-conducting, electrically-insulating material (hereinafter "MCEI material") may be located within the trough of the annular housing to contain and channel a magnetic field emanated from the electrical conductor, and to prevent direct physical contact between the electrical conductor and the housing.

In selected embodiments, the MCEI material conforms to the trough in the annular housing. A trough may also be formed in the MCEI material to accommodate the electrical conductor. In certain embodiments, the MCEI material may be provided in the form of multiple segments positioned around the circumference of the trough of the annular housing. The annular housing may be formed to retain the MCEI segments in substantially fixed positions within the housing. In certain embodiments, the MCEI material may be a ferrite, a composition containing a ferrite, or a material having similar magnetic and electrical properties to a ferrite.

In selected embodiments, a trough formed in the annular housing may include one or several retaining shoulders. Likewise, the MCEI material may be formed to include one or several corresponding shoulder to mechanically engage the retaining shoulder, thereby effectively positioning the MCEI material with respect to the annular housing and preventing the MCEI material from exiting the trough of the annular housing. In selected embodiments, the electrical conductor is coated with an insulating material. In other embodiments, the electrical conductor may simply be a single coil within the annular housing or may comprise a plurality of conductive strands coiled around the circumference of the annular housing.

The annular housing may be configured to reside in an annular recess milled, formed, or otherwise provided in a substrate, such as in the mating surfaces of the pin end or box end of a drill pipe or other downhole component. Correspondingly, the exterior surface of the annular housing may be formed to include one or more locking shoulders. The annular recess may also include one or more corresponding locking shoulders to engage locking shoulders of the annular housing, thereby preventing separation of the annular housing from the substrate.

In selected embodiments, the annular housing is dimensioned to reside substantially flush with the surface of the substrate when in the annular recess. Likewise, the MCEI segments may also be dimensioned or designed to reside in the trough of the annular housing such that they are substantially flush with the annular housing, the substrate, or both. In selected embodiments, the apparatus may comprise a biasing member, such as a spring or elastomeric material. This biasing member may be located between the annular recess and the annular housing, or may be located between the annular housing and the MCEI material, for example.

In another aspect of the present invention, an apparatus for transmitting data between downhole tools may include an annular housing having a circumference. The annular housing may have a substantially U-shaped cross-section around the circumference thereof. An MCEI material may be placed or located within the annular housing. The MCEI material may have a substantially U-shaped cross-section substantially conforming to the inside of the annular housing, although this is not necessary.

An electrical conductor may be disposed within the U-shape cross-section of the MCEI material. In certain embodiments, the MCEI material may be comprised of a plurality of MCEI segments positioned around the circumference of the annular housing. The annular housing may be formed to retain the MCEI segments in substantially fixed positions. In selected embodiments, the MCEI material may comprise a ferrite, compositions including a ferrite, or materials have ferrite-like magnetic and electrical properties.

BRIEF DESCRIPTION OF THE DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

In an effort to overcome limitations imposed by mud pulse telemetry systems, reliable connections are needed to transmit information between components in a drill string. For example, since direct electrical connections between drill string components may be impractical and unreliable due to dirt, mud, rocks, air gaps, and the like between components, converting electrical signals to magnetic fields for later conversion back to electrical signals is suggested for transmitting information between drill string components.

Like a transformer, current traveling through a first conductive coil, located on a first drill string component, may be converted to a magnetic field. The magnetic field may then be detected by a second conductive coil located on a second drill string component where it may be converted back into an electrical signal mirroring the first electrical signal. A core material, such as a ferrite, may be used to channel magnetic fields in a desired direction to prevent power loss. However, past attempts to use this "transformer" approach have been largely unsuccessful due to a number of reasons.

For example, power loss may be a significant problem. Due to the nature of the problem, signals must be transmitted from one pipe section, or downhole tool, to another. Thus, air or other gaps are present between the core material of transmission elements. This may incur significant energy loss, since the permeability of ferrite, and other similar materials, may be far greater than air, lubricants, pipe sealants, or other materials. Thus, apparatus and methods are needed to minimize power loss in order to effectively transmit and receive data.

Figure 1:
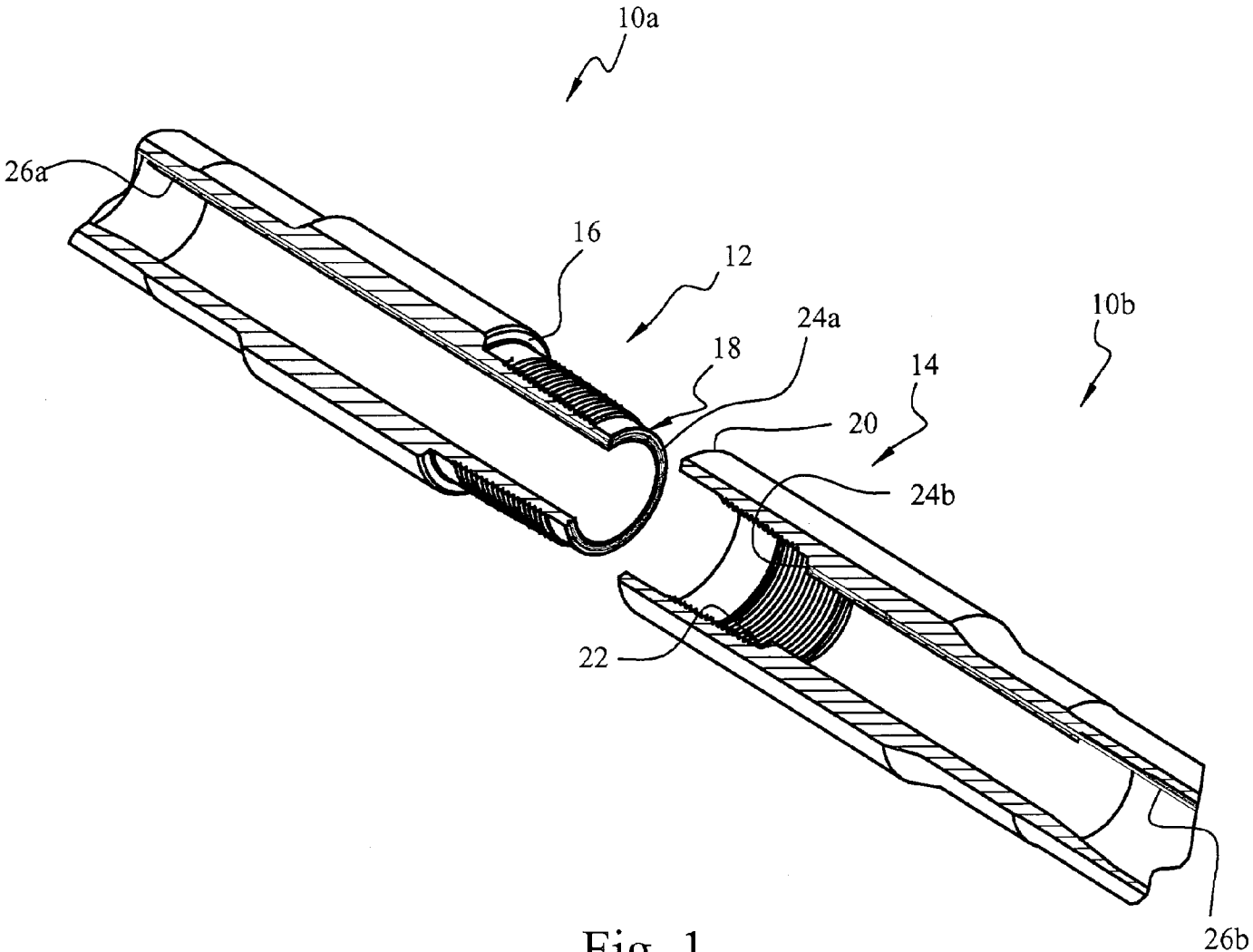
FIG. 1 is a perspective view illustrating one embodiment of transmission elements installed into the box and pin ends of a downhole-drilling pipe to transmit and receive information along a drill string.

Referring to FIG. 1, drill pipes 10*a*, 10*b*, or other downhole tools 10*a*, 10*b*, may include a pin end 12 and a box end 14 to connect drill pipes 10*a*, 10*b* or other components 10*a*, 10*b* together. In certain embodiments, a pin end 12 may include an external threaded portion to engage an internal threaded portion of the box end 14. When threading a pin end 12 into a corresponding box end 14, various shoulders may engage one another to provide structural support to components connected in a drill string.

For example, a pin end 12 may include a primary shoulder 16 and a secondary shoulder 18. Likewise, the box end 14 may include a corresponding primary shoulder 20 and secondary shoulder 22. A primary shoulder 16, 20 may be labeled as such to indicate that a primary shoulder 16, 20 provides the majority of the structural support to a drill pipe 10 or downhole component 10. Nevertheless, a secondary shoulder 18 may also engage a corresponding secondary shoulder 22 in the box end 14, providing additional support or strength to drill pipes 10 or components 10 connected in series.

As was previously discussed, apparatus and methods are needed to transmit information along a string of connected drill pipes 10 or other components 10. As such, one major issue is the transmission of information across joints where a pin end 12 connects to a box end 14. In selected embodiments, a transmission element 24*a* may be mounted proximate a mating surface 18 or shoulder 18 on a pin end 12 to communicate information to another transmission element 24*b* located on a mating surface 22 or shoulder 22 of the box end 14. Cables 26*a*, 26*b*, or other transmission media 26, may be operably connected to the transmission elements 24*a*, 24*b* to transmit information therefrom along components 10*a*, 10*b*.

In certain embodiments, an annular recess may be provided in the secondary shoulder 18 of the pin end 12 and in the secondary shoulder 22 of the box end 14 to house each of the transmission elements 24*a*, 24*b*. The transmission elements 24*a*, 24*b* may have an annular shape and be mounted around the radius of the drill pipe 10. Since a secondary shoulder 18 may contact or come very close to a secondary shoulder 22 of a box end 14, a transmission element 24*a* may sit substantially flush with a secondary shoulder 18 on a pin end 12. Likewise, a transmission element 24*b* may sit substantially flush with a surface of a secondary shoulder 22 of a box end 14.

In selected embodiments, a transmission element 24*a* may be coupled to a corresponding transmission element 24*b* by having direct electrical contact therewith. In other embodiments, the transmission element 24*a* may convert an electrical signal to a magnetic field or magnetic current. A corresponding transmission element 24*b*, located proximate the transmission element 24*a*, may detect the magnetic field or current. The magnetic field may induce an electrical current into the transmission element 24*b*. This electrical current may then be transmitted from the transmission element 24*b* by way of an electrical cable 26*b* along the drill pipe 10 or downhole component 10.

As was previously stated, a downhole drilling environment may adversely affect communication between transmission elements 24*a*, 24*b* located on successive drill string components 10. Materials such as dirt, mud, rocks, lubricants, or other fluids, may inadvertently interfere with the contact or coupling between transmission elements 24*a*, 24*b*. In other embodiments, gaps present between a secondary shoulder 18 on a pin end 12 and a secondary shoulder 22 on a box end 14, due to variations in component tolerances, may interfere with communication between transmission elements 24*a*, 24*b*. Thus, apparatus and methods are needed to reliably overcome these as well as other obstacles.

Figure 2:
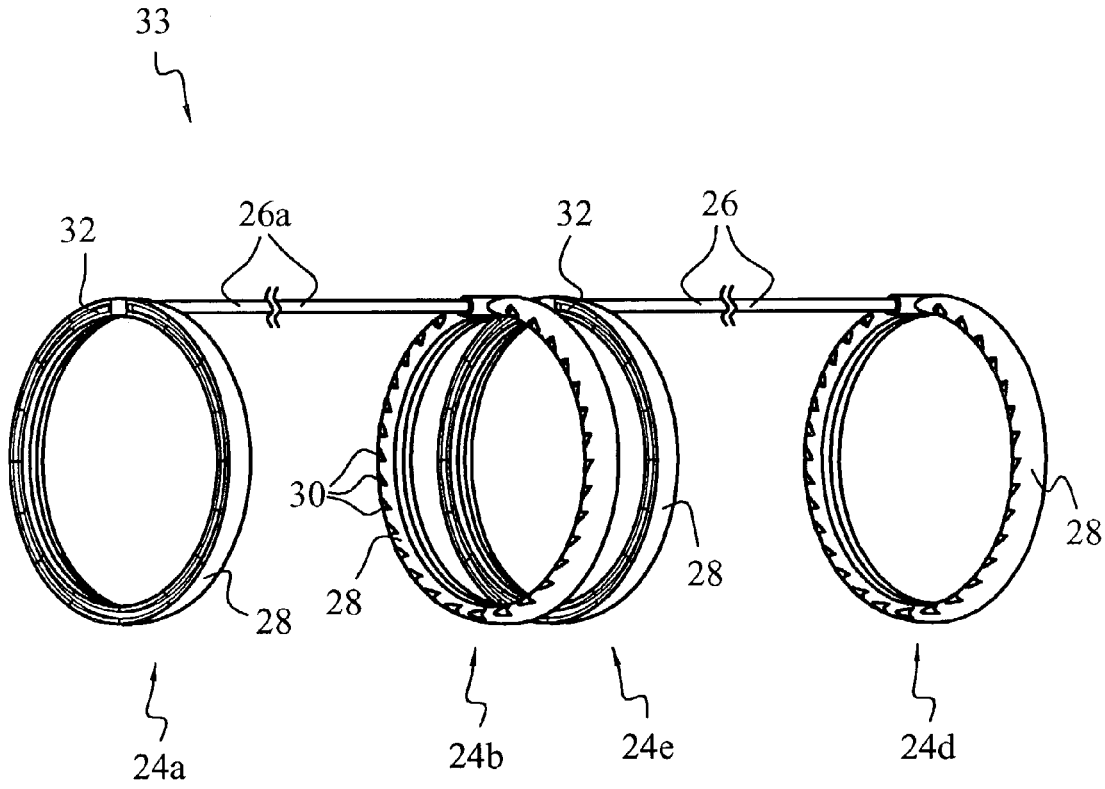
FIG. 2 is a perspective view illustrating one embodiment of the interconnection and interaction between transmission elements.

Referring to FIG. 2, in selected embodiments, a transmission element assembly 33 may include a first transmission element 24*a* mounted in the pin end 12 of a drill pipe 10 or other tool 10, and a second transmission element 24*b* mounted in the box end 14 of a drill pipe 10 or other tool 10. Each of these transmission elements 24*a*, 24*b* may be operably connected by a cable 26*a*, such as electrical wires, coaxial cable, optical fiber, or like transmission media. Each of the transmission elements 24 may include an exterior annular housing 28. The annular housing 28 may function to protect and retain components or elements within the transmission element 24. The annular housing 28 may have an exterior surface shaped to conform to a recess milled, formed, or otherwise provided in the pin 12 or box end 14 of a drill pipe 10, or other downhole component 10.

In selected embodiments, the annular housing 28 may be surfaced to reduce or eliminate rotation of the transmission elements 24 within their respective recesses. For example, anti-rotation mechanisms, such as barbs or other surface features formed on the exterior of the annular housing 28 may serve to reduce or eliminate rotation.

As is illustrated in FIG. 2, a transmission element 24*b* located on a first downhole tool 10 may communicate with a transmission element 24*c* located on a second downhole tool 10. Electrical current transmitted through a coil 32 in a first transmission element 24*b* may create a magnetic field circulating around the conductor 32. A second transmission element 24*c* may be positioned proximate the first transmission element 24*b* such that the magnetic field is detected by a coil 32 in the transmission element 24*c*.

In accordance with the laws of electromagnetics, a magnetic field circulated through an electrically conductive loop induces an electrical current in the loop. Thus, an electrical signal transmitted to a first transmission element 24*b* may be replicated by a second transmission element 24*c*. Nevertheless, a certain amount of signal loss occurs at the coupling of the transmission element 24*b*, 24*c*. For example, signal loss may be caused by air or other gaps present between the transmission elements 24*b*, 24*c*, or by the reluctance of selected magnetic materials. Thus, apparatus and methods are needed to reduce, as much as possible, signal loss that occurs between transmission elements 24*b*, 24*c*.

Figure 3:
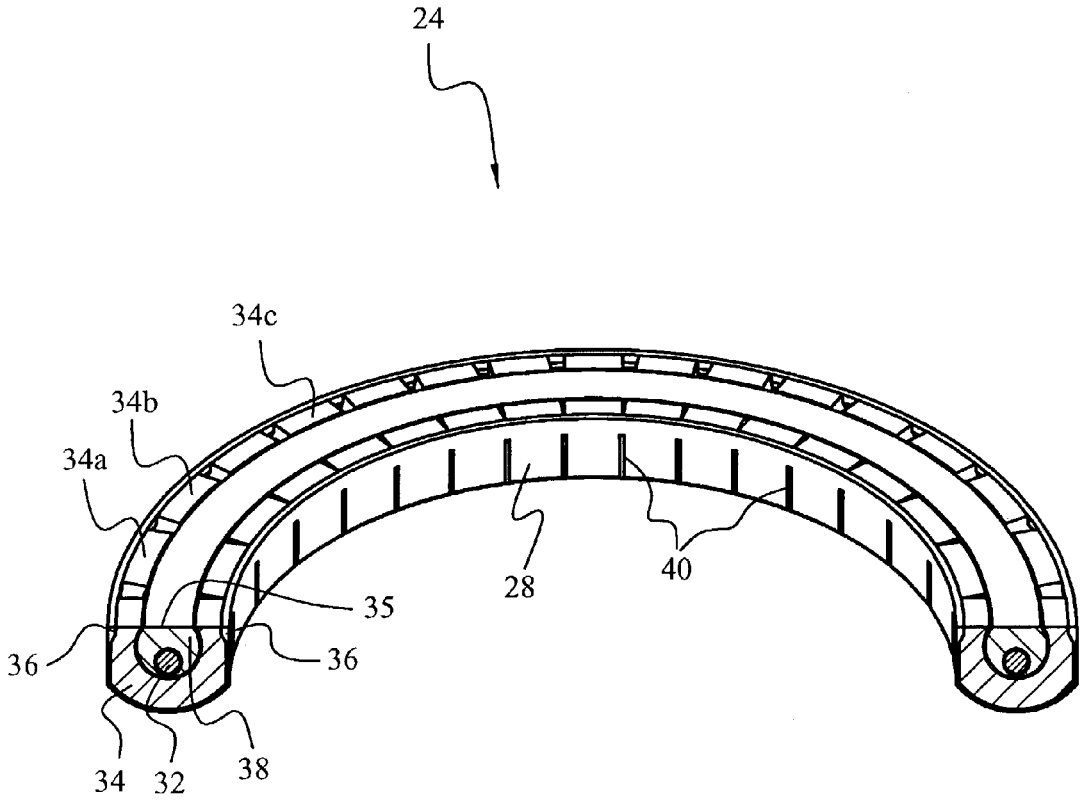
FIG. 3 is a perspective cross-sectional view illustrating various features of one embodiment of an improved transmission element in accordance with the invention.

Referring to FIG. 3, a perspective cross-sectional view of one embodiment of a transmission element 24 is illustrated. In selected embodiments, a transmission element 24 may include an annular housing 28, an electrical conductor 32, and a magnetically-conducting, electrically-insulating material 34 separating the conductor 32 from the housing 28.

The MCEI material 34 may prevent electrical shorting between the electrical conductor 32 and the housing 28. In addition, the MCEI material 34 contains and channels magnetic flux emanating from the electrical conductor 32 in a desired direction. In order to prevent signal or power loss, magnetic flux contained by the MCEI material 34 may be directed or channeled to a corresponding transmission element 24 located on a connected downhole tool 10.

The MCEI material 34 may be constructed of any material having suitable magnetically-conductive and electrically-insulating properties. For example, in selected embodiments, certain types of metallic oxide materials such as ferrites, may provide desired characteristics. Ferrites may include many of the characteristics of ceramic materials. Ferrite materials may be mixed, pre-fired, crushed or milled, and shaped or pressed into a hard, typically brittle state. Selected types of ferrite may be more preferable for use in the present invention, since various types operate better at higher frequencies.

Since ferrites or other magnetic materials may be quite brittle, using an MCEI material 34 that is a single piece may be impractical, unreliable, or susceptible to cracking or breaking. Thus, in selected embodiments, the MCEI material 34 may be provided in various segments 34*a–c*. Using a segmented MCEI material 34*a–c* may relieve tension that might otherwise exist in a single piece of ferrite. If the segments 34 are positioned sufficiently close to one another within the annular housing 28, signal or power loss between joints or gaps present between the segments 34*a–c* may be minimized.

The annular housing 28, MCEI material 34, and conductor 32 may be shaped and aligned to provide a relatively flat face 35 for interfacing with another transmission element 24. Nevertheless, a totally flat face 35 is not required. In selected embodiments, a filler material 38 or insulator 38 may be used to fill gaps or volume present between the conductor 32 and the MCEI material 34. In addition, the filler material 38 may be used to retain the MCEI segments 34*a–c*, the conductor 32, or other components within the annular housing 28.

In selected embodiments, the filler material 38 may be any suitable polymer material such as Halar, or materials such as silicone, epoxies, and the like. The filler material 38 may have desired electrical and magnetic characteristics, and be able to withstand the temperature, stress, and abrasive characteristic of a downhole environment. In selected embodiments, the filler material 38 may be surfaced to form to a substantially planer surface 35 of the transmission element 24.

In selected embodiments, the annular housing 28 may include various ridges 40 or other surface characteristics to enable the annular housing 28 to be press fit and retained within an annular recess. These surface characteristics 40 may be produced by stamping, forging, or the like, the surface of the housing 28. In selected embodiments, the annular housing 28 may be formed to retain the MCEI material 34, the conductor 32, any filler material 38, and the like. For example, one or several locking shoulders 36 may be provided or formed in the walls of the annular housing 28. The locking shoulders 36 may allow insertion of the MCEI material 34 into the annular housing 28, while preventing the release therefrom.

Figure 4:
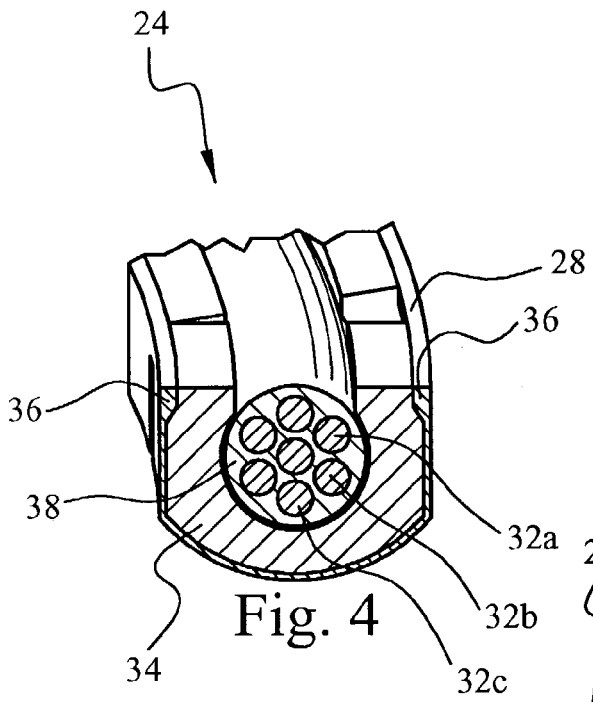
FIG. 4 is a perspective cross-sectional view illustrating one embodiment of a multi-coil or multi-strand conductor within a transmission element, and various locking shoulders used to retain the MCEI segments within the annular housing.

Referring to FIG. 4, in selected embodiments, the electrical conductor 32 may include multiple strands 32*a–c*, or multiple coils 32*a–c*, coiled around the circumference of the annular housing 28. In selected embodiments, multiple coils 32*a–c* may enable or improve the conversion of electrical current to a magnetic field. The coils 32*a–c*, or loops 32*a–c*, may be insulated separately or may be encased together by an insulation 38 or filling material 38.

Figure 5:
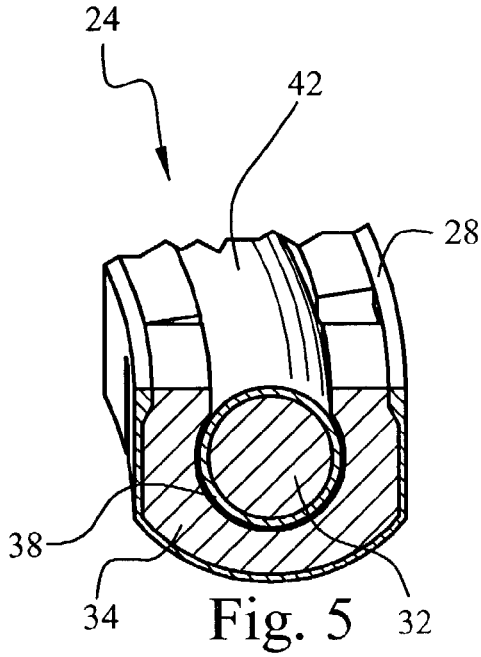
FIG. 5 is a perspective cross-sectional view illustrating one embodiment of a single conductor or coil used within the transmission element.

Referring to FIG. 5, in another embodiment, the transmission element 24 may include a single coil 32, or loop 32. The single loop 32 may occupy substantially the entire volume within the MCEI material 34. An insulated conductor 32 may simply provide a rounded surface for interface with another transmission element 24.

Figure 6:
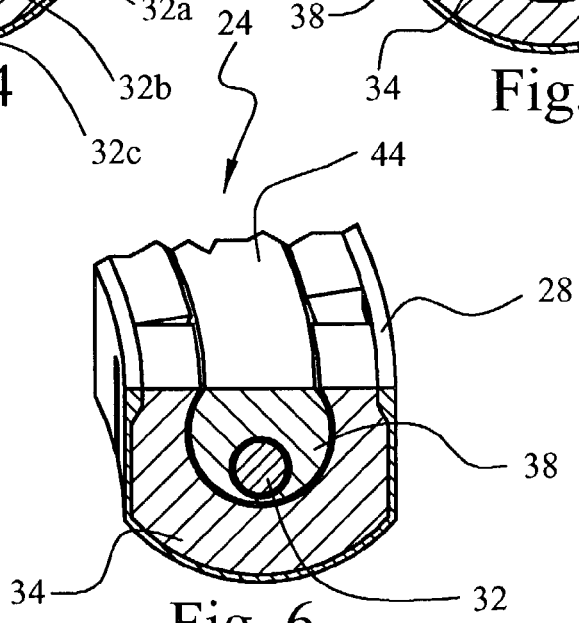
FIG. 6 is a perspective cross-sectional view illustrating one embodiment of a single conductor or coil surrounded by an electrically insulating material used within the transmission element.

Referring to FIG. 6, in another embodiment, the conductor 32 may be much smaller and may or may not be surrounded by a filler material 38. The filler material 38 may be leveled off to provide a planar or substantially flat surface 44 for interfacing with another transmission element 24. In certain cases, a larger electrical conductor 32 may provide better performance with respect to the conversion of electrical energy to magnetic energy, and the conversion of magnetic energy back to electrical energy.

Figure 7:
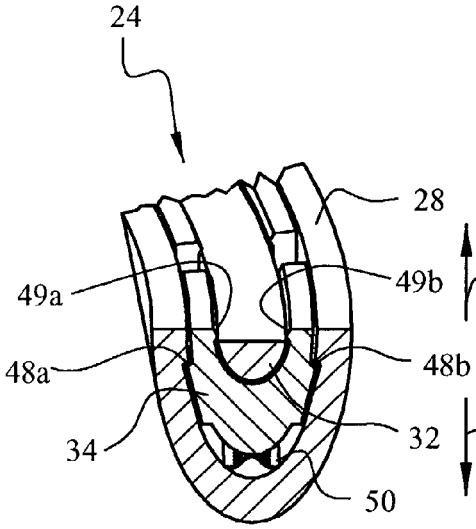
FIG. 7 is a perspective cross-sectional view illustrating another embodiment of a transmission element having a flat or planar area formed on the conductor in accordance with the invention.

Referring to FIG. 7, in selected embodiments, a transmission element 24 may have a rounded shape. The annular housing 28, the MCEI material 34, and the conductor 32 may be configured to interlock with one another. For example, the annular housing 28 may be formed to include one or more shoulders 48*a*, 48*b* that may interlock with and retain the MCEI material 34.

In certain embodiments, a biasing member 50 such as a spring 50 or other spring-like element 50 may function to keep the MCEI material 34 loaded and pressed against the shoulders 48*a*, 48*b* of the annular housing 28. The shoulders 48*a*, 48*b* may be dimensioned to enable the MCEI material 34 to be inserted into the annular housing 28, while preventing the release thereof. In a similar manner, the conductor 32 may be configured to engage shoulders 49*a*, 49*b* formed into the MCEI material 34. In the illustrated embodiment, the conductor 32 has a substantially flat or planar surface 44. This may improve the coupling, or power transfer to another transmission element 24.

Figure 8:
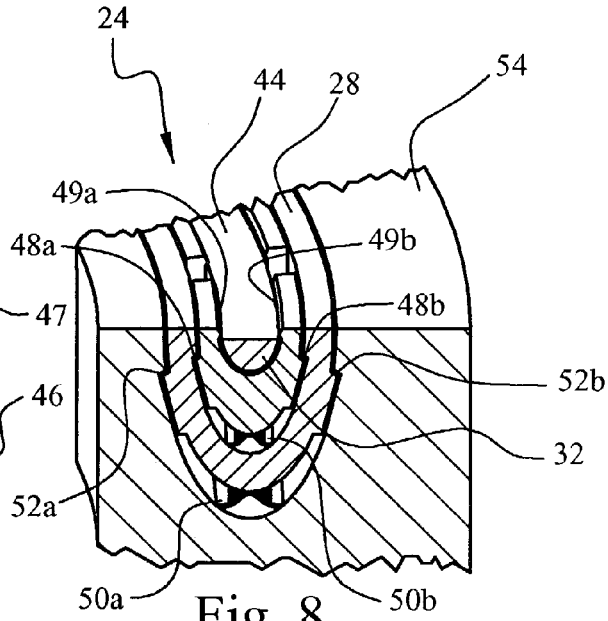
FIG. 8 is a perspective cross-sectional view illustrating one embodiment of a transmission element having various biasing members to urge components of the transmission element into desired positions.

Referring to FIG. 8, in another embodiment, locking or retaining shoulders 52*a*, 52*b* may be milled, formed, or otherwise provided in a substrate material 54, such as in the primary or secondary shoulders 16, 18, 20, 22 of drill pipes 10 or downhole tools 10. Likewise, corresponding shoulders may be formed in the annular housing 28 to engage the shoulders 52*a*, 52*b*.

A biasing member, such as a spring 50*a*, or spring-like member 50*a*, may be inserted between the annular housing 28 and the MCEI material 34. The biasing members 50*a*, 50*b* may enable the transmission element 24 to be inserted a select distance into the annular recess of the substrate 54. Once inserted, the biasing members 50*a*, 50*b* may serve to keep the annular housing 28 and the MCEI material 34 pressed against the shoulders 48*a*, 48*b*, 52*a*, 52*b*.

In addition, shoulders 48*a*, 48*b*, 52*a*, 52*b* may provide precise alignment of the annular housing 28, MCEI material 34, and conductor 32 with respect to the surface of the substrate 54. Precise alignment may be desirable to provide consistent separation between transmission elements 24 communicating with one another. Consistent separation between transmission elements 24 may reduce reflections and corresponding power loss when signals are transmitted from one transmission element 24 to another 24.

Figure 9:
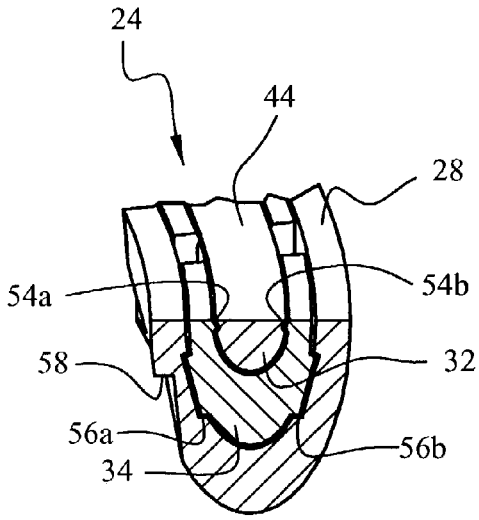
FIG. 9 is a perspective cross-sectional view illustrating one embodiment of a transmission element having a shelf or ledge formed in the annular housing to accurately position the transmission element with respect to a substrate.

Referring to FIG. 9, in selected embodiments, a transmission element 24 may include an alignment surface 58 machined, cast, or otherwise provided in the exterior surface of the annular housing 28. The alignment surface 58 may engage a similar surface milled or formed into an annular recess of a substrate 54. This may enable precise alignment of the annular housing 28 and other components 32, 34 with the surface of a substrate 54.

In certain embodiments, the conductor 32 may be provided with grooves 54*a*, 54*b* or shoulders 54*a*, 54*b* that may engage corresponding shoulders milled or formed into the MCEI material 34. This may enable a surface 44 of the conductor 32 to be level or flush with the surface of the MCEI material 34 and the annular housing 28. In some cases, such a configuration may enable direct physical contact of conductors 32 in the transmission elements 24 when they are coupled together. This may enhance the coupling effect of the transmission elements 24 and enable more efficient transfer of energy therebetween. As is illustrated in FIG. 9, lower shoulders 56*a*, 56*b* formed into the annular housing 28 and the MCEI material 34 may provide a substantially fixed relationship between the annular housing 28 and the MCEI material 34.

Figure 10:
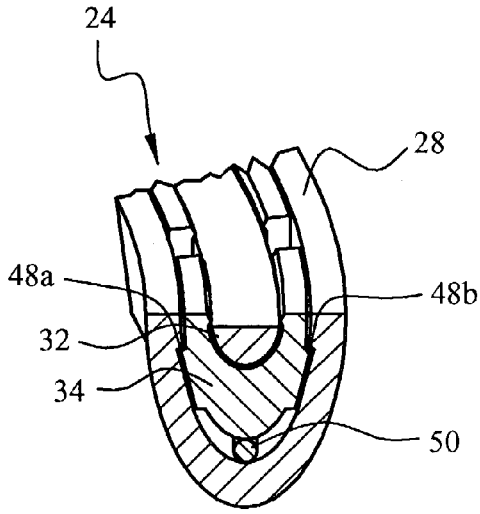
FIG. 10 is a perspective cross-sectional view illustrating one embodiment of a transmission element having an elastomeric or elastomeric-like material to urge the components of the transmission element into desired positions.

Referring to FIG. 10, in selected embodiments, a biasing member 50 composed of an elastomeric or elastomeric-like material may be inserted between components such as the annular housing 28 and the MCEI material 34. As was previously described with respect to FIG. 7, the biasing member 50 may keep the MCEI material 34 pressed up against shoulders 48*a*, 48*b* of the annular housing 28 to provide precise alignment of the MCEI material 34 with the annular housing 28.

Figure 11:
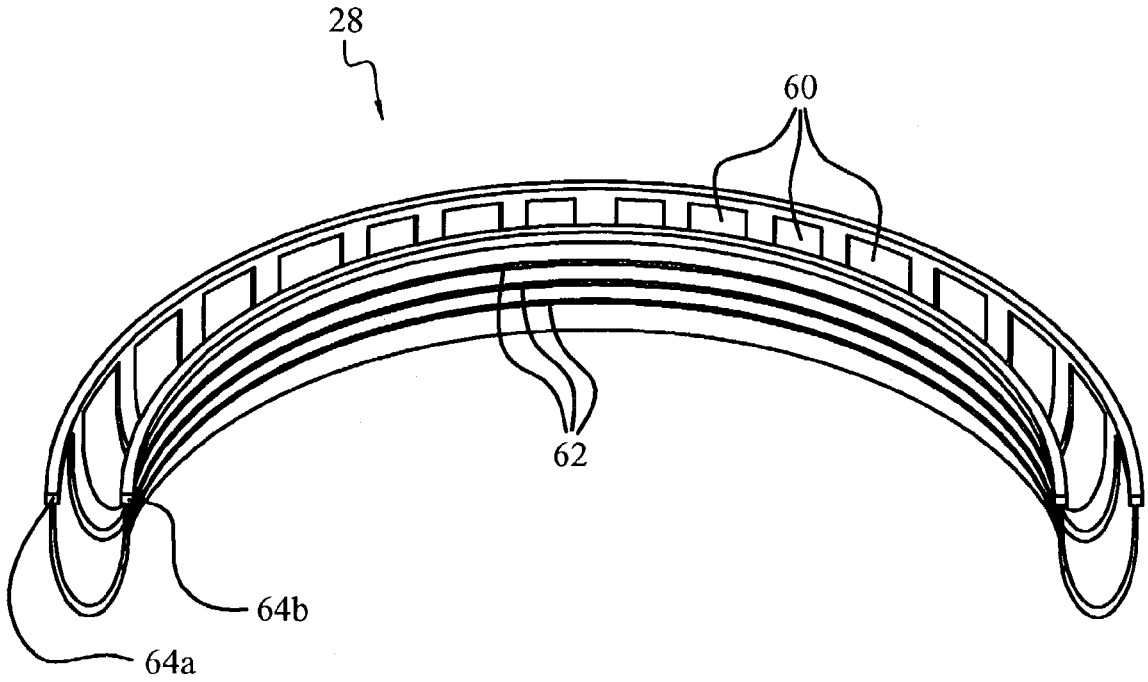
FIG. 11 is a perspective cross-sectional view illustrating on embodiment of an annular housing capable of retaining MCEI segments in substantially fixed positions within the annular housing.

Referring to FIG. 11, in selected embodiments, the annular housing 28 may be formed, stamped, milled, or the like, as needed, to maintain alignment or positioning of various components within the annular housing 28. For example, various retention areas 60 may be formed into the annular housing 28 to provide consistent spacing of MCEI segments 34*a–c*. The retention areas 60 may simply be stamped or hollowed areas within the annular housing 28, or they may be cutout completely from the surface thereof.

Likewise, one or multiple ridges 62 or other surface features 62 may be provided to retain the annular housing 28 in an annular recess when the annular housing 28 is press-fit or inserted into the recess. The annular housing 28 may also include various shoulders 64*a*, 64*b* that may engage corresponding shoulders milled or formed into the annular recess to provide precise alignment therewith and to provide a consistent relationship between the surfaces of the transmission element 24 and the substrate 54.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. An apparatus for transmitting data between downhole tools, the apparatus comprising:

an annular housing having a circumference, the annular housing forming a first trough around the circumference thereof;

at least one electrical conductor disposed within the first trough; and a MCEI material disposed between the first trough and the electrical conductor, preventing direct physical contact therebetween.

2. The apparatus of claim 1, wherein:

the MCEI material conforms to the first trough; and a second trough is formed in the MCEI material to accommodate the at least one electrical conductor.

3. The apparatus of claim 1, wherein the MCEI material is comprised of a plurality of MCEI segments positioned around the circumference of the first trough.

4. The apparatus of claim 3, wherein the annular housing is formed to retain the MCEI segments in substantially fixed positions.

5. The apparatus of claim 1, wherein the MCEI material comprises a ferrite.

6. The apparatus of claim 1, wherein:

the first trough is formed to include at least one retaining shoulder; and the MCEI material is formed to include a corresponding shoulder to engage the retaining shoulder, preventing the MCEI material from exiting the first trough.

7. The apparatus of claim 1, wherein the at least one conductor is electrically insulated.

8. The apparatus of claim 1, wherein the at least one conductor comprises a plurality of conductive strands coiled around the circumference.

9. The apparatus of claim 1, wherein:

the annular housing is characterized by an exterior surface; and the exterior surface is formed to reside in an annular recess in a substrate.

10. The apparatus of claim 9, wherein:

the exterior surface is formed to include at least one locking shoulder; and the locking shoulder is configured to engage at least one corresponding shoulder within the annular recess.

11. The apparatus of claim 9, wherein the annular housing is formed to reside in the annular recess substantially flush with the surface of the substrate.

12. The apparatus of claim 11, wherein the MCEI segments are formed to reside in the first trough substantially flush with at least one of the annular housing and the substrate.

13. The apparatus of claim 9, further comprising a biasing member located between at least one of the annular recess and the annular housing, and the annular housing and the MCEI material.

14. An apparatus for transmitting data between downhole tools, the apparatus comprising:

an annular housing having a circumference, the annular housing having a substantially U-shaped cross-section around the circumference thereof;

an MCEI material located within the annular housing, the MCEI material having a substantially U-shaped cross-section substantially conforming to the inside of the annular housing; and at least one electrical conductor disposed within the U-shape cross-section of the MCEI material.

15. The apparatus of claim 14, wherein the MCEI material is comprised of a plurality of MCEI segments positioned around the circumference of the annular housing.

16. The apparatus of claim 15, wherein the annular housing is formed to retain the MCEI segments in substantially fixed positions.

17. The apparatus of claim 14, wherein the MCEI material comprises a ferrite.

18. The apparatus of claim 14, wherein:

the interior of the annular housing is formed to include at least one retaining shoulder; and the MCEI material is formed to include a corresponding shoulder to engage the retaining shoulder, preventing the MCEI material from exiting the annular housing.

19. The apparatus of claim 14, wherein the at least one conductor comprises a plurality of conductive strands coiled around the circumference.

20. The apparatus of claim 14, wherein:

the annular housing is characterized by an exterior surface; and the exterior surface is formed to reside in an annular recess in a substrate.

* * * * *